US008983341B2

(12) United States Patent
Moon et al.

(10) Patent No.: US 8,983,341 B2
(45) Date of Patent: Mar. 17, 2015

(54) DEVELOPING DEVICE AND ELECTROPHOTOGRAPHIC IMAGE FORMING APPARATUS INCLUDING THE SAME

(75) Inventors: Ji-won Moon, Anyang-si (KR); Joo-hwan Noh, Yongin-si (KR); Dong-kyu Lee, Cheonan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 73 days.

(21) Appl. No.: 13/562,348

(22) Filed: Jul. 31, 2012

(65) Prior Publication Data

US 2013/0129389 A1 May 23, 2013

(30) Foreign Application Priority Data

Nov. 17, 2011 (KR) ..... 10-2011-0120319

(51) Int. Cl.
*G03G 15/08* (2006.01)
*G03G 15/01* (2006.01)
*G03G 21/16* (2006.01)

(52) U.S. Cl.
CPC ..... *G03G 15/0189* (2013.01); *G03G 21/1676* (2013.01); *G03G 15/0121* (2013.01)
USPC ..... 399/258; 399/119; 399/262

(58) Field of Classification Search
CPC ..... G03G 15/0822; G03G 15/0877; G03G 15/0832; G03G 15/0834; G03G 15/0836; G03G 15/0837; G03G 15/0865; G03G 15/0867; G03G 15/0868; G03G 15/087; G03G 15/0872; G03G 15/0875
USPC ..... 399/119, 258–260, 262
See application file for complete search history.

(56) References Cited

U.S. PATENT DOCUMENTS

| | | | | |
|---|---|---|---|---|
| 6,249,664 | B1 * | 6/2001 | Sato | 399/256 |
| 6,314,261 | B1 * | 11/2001 | Omata et al. | 399/258 |
| 6,449,451 | B2 | 9/2002 | Tsuruya et al. | |
| 6,795,660 | B2 * | 9/2004 | Yugeta et al. | 399/27 |
| 7,415,237 | B2 * | 8/2008 | Okoshi | 399/350 |
| 7,502,577 | B2 * | 3/2009 | Kitozaki et al. | 399/258 |
| 7,515,853 | B2 * | 4/2009 | Kimura et al. | 399/258 |
| 7,536,122 | B2 * | 5/2009 | Ohkawa et al. | 399/27 |
| 7,668,470 | B2 * | 2/2010 | Tsuji et al. | 399/27 |

(Continued)

FOREIGN PATENT DOCUMENTS

| | | |
|---|---|---|
| EP | 1357441 | 10/2003 |
| JP | 4672893 | 10/2002 |
| JP | 4696168 | 7/2009 |

OTHER PUBLICATIONS

Extended European Search Report dated Jul. 30, 2013 issued in EP Application No. 12180876.0.

(Continued)

*Primary Examiner* — David Gray
*Assistant Examiner* — Carla J Therrien
(74) *Attorney, Agent, or Firm* — Staas & Halsey LLP

(57) ABSTRACT

An electrophotographic image forming apparatus including first and second developing devices to develop electrostatic latent images formed on first and second photosensitive bodies, each of the first and second developing devices comprise a first toner containing unit to contain a toner, the second developing device further including a second toner containing unit that is connected to the first toner containing unit by a connecting unit.

25 Claims, 8 Drawing Sheets

(56) References Cited

U.S. PATENT DOCUMENTS

| | | | | |
|---|---|---|---|---|
| 7,715,765 | B2 * | 5/2010 | Ichikawa et al. | 399/258 |
| 7,778,570 | B2 | 8/2010 | Numagami et al. | |
| 7,805,096 | B2 * | 9/2010 | Ishiguro et al. | 399/258 |
| 7,881,643 | B2 * | 2/2011 | Lee | 399/258 |
| 7,957,679 | B2 * | 6/2011 | Nakajima et al. | 399/262 |
| 8,023,858 | B2 * | 9/2011 | Shinoda | 399/106 |
| 8,027,621 | B2 * | 9/2011 | Isomura et al. | 399/258 |
| 8,045,899 | B2 | 10/2011 | Kawai | |
| 8,135,306 | B2 * | 3/2012 | Tamaru | 399/112 |
| 8,320,802 | B2 * | 11/2012 | Tanaka | 399/263 |
| 8,472,849 | B2 * | 6/2013 | Tanaka | 399/263 |
| 8,588,661 | B2 * | 11/2013 | Ota | 399/263 |
| 2002/0141788 | A1 | 10/2002 | Matsuda et al. | |
| 2004/0052538 | A1 * | 3/2004 | Yugeta et al. | 399/27 |
| 2004/0100547 | A1 | 5/2004 | Hattori | |
| 2006/0216083 | A1 * | 9/2006 | Okoshi | 399/350 |
| 2007/0258727 | A1 * | 11/2007 | Shinoda | 399/106 |
| 2007/0286646 | A1 * | 12/2007 | Ichikawa et al. | 399/262 |
| 2009/0175656 | A1 * | 7/2009 | Kim et al. | 399/221 |
| 2009/0220284 | A1 | 9/2009 | Lee | |
| 2009/0297226 | A1 * | 12/2009 | Nagashima et al. | 399/258 |
| 2010/0021201 | A1 * | 1/2010 | Tamaru | 399/113 |
| 2010/0232813 | A1 * | 9/2010 | Okamoto | 399/12 |
| 2011/0103846 | A1 * | 5/2011 | Ota | 399/263 |
| 2011/0222915 | A1 | 9/2011 | Furuhata | |
| 2012/0275821 | A1 * | 11/2012 | Watanabe | 399/111 |

OTHER PUBLICATIONS

European Examination Report dated Jul. 21, 2014 issued in EP Application No. 12180876.0.

Chinese Office Action dated Jun. 3, 2014 issued in CN Application No. 201210382426.9.

Korean Patent Office Action issued in Korean Patent Application No. 10-2011-0120319 dated Sep. 16, 2014.

* cited by examiner

DEVELOPING DEVICE AND ELECTROPHOTOGRAPHIC IMAGE FORMING APPARATUS INCLUDING THE SAME

CROSS-REFERENCE TO RELATED APPLICATIONS

This application claims priority under 35 U.S.C. §119 from Korean Patent Application No. 10-2011-0120319, filed on Nov. 17, 2011, in the Korean Intellectual Property Office, the disclosure of which is incorporated herein in its entirety by reference.

BACKGROUND OF THE INVENTION

1. Field of the Invention

The present general inventive concept relates to a developing device and an electrophotographic image forming apparatus including the same, and more particularly, to a developing device for increasing the amounts of contained toners and an electrophotographic image forming apparatus including the same.

2. Description of the Related Art

An image forming apparatus using an electrophotographic method, such as a laser printer, a general paper facsimile, a copier, or the like, prints an image on a medium by using an electrophotographic image forming system. An electrophotographic image forming system forms an electrostatic latent image by irradiating light corresponding to image information to a photosensitive body and forms a toner image by supplying a toner to the electrostatic latent image. Then, the toner image is transferred onto a recording medium and heat and pressure are applied thereto, thereby printing an image onto the recording medium.

An electrophotographic color image forming apparatus may include four developing devices that respectively contain toners of, for example, cyan (C), magenta (M), yellow (Y), and black (K). When a toner contained in a developing device is exhausted, the developing device is replaced with a new developing device. When a color image forming apparatus is used, since a text document is frequently printed, black toner is rapidly consumed.

SUMMARY OF THE INVENTION

The present general inventive concept provides a developing device for increasing the amounts of contained toners while minimizing the size of an image forming apparatus, and an electrophotographic image forming apparatus including the same.

Additional features and utilities of the present general inventive concept will be set forth in part in the description which follows and, in part, will be obvious from the description, or may be learned by practice of the general inventive concept.

The present general inventive concept also provides a developing device for increasing the amount of a contained toner that is highly frequently used while minimizing the size of an image forming apparatus, and an electrophotographic image forming apparatus including the same.

Exemplary embodiments of the present general inventive concept can also provide an electrophotographic image forming apparatus including a plurality of photosensitive bodies, an exposer to irradiate light to each of the plurality of photosensitive bodies to form an electrostatic latent image, and a plurality of developing devices each including a developing unit to supply a toner to the electrostatic latent image on a corresponding photosensitive body from among the plurality of photosensitive bodies to form a toner image and a first toner containing unit to contain a toner to be supplied to the developing unit, where at least one developing device from among the plurality of developing devices includes a second toner containing unit in aside opposite to the first toner containing unit with respect to an optical path of light that is irradiated to the corresponding photosensitive body of the at least one developing device and a connecting unit to connect the first and second toner containing units.

The electrophotographic image forming apparatus may further include an intermediate transfer belt that is disposed to face the plurality of photosensitive bodies and to which the toner image is transferred, where the at least one developing device may be disposed on a most downstream region with respect to a proceeding direction of the intermediate transfer belt.

Pitches of the plurality of photosensitive bodies may be equal to each other in the proceeding direction of the intermediate transfer belt.

In the electrophotographic image forming apparatus, the second toner containing unit is disposed on a downstream region with respect to the proceeding direction, compared to the first toner containing unit of the developing unit. Each of the plurality of developing devices may include a waste toner containing unit to contain waste toner removed from the photosensitive bodies, and the waste toner containing unit of the at least one developing device may be disposed below the second toner containing unit.

The plurality of developing devices may have the same length in the proceeding direction.

The plurality of developing devices may have the same height.

A length of the at least one developing device in the proceeding direction may be greater than a length of the remaining developing devices in the proceeding direction. The first toner containing units of the plurality of developing devices may have the same length in the proceeding direction. The plurality of developing devices may have the same height.

The connecting unit may be disposed outside an effective width of the optical path. An agitating member to supply toner to the first toner containing unit through the connecting unit may be disposed in the second toner containing unit. The agitating member may include a rotation axis that extends in a width direction and an agitating wing that extends from the rotation axis in a radial direction. A bottom portion of the second toner containing unit may be inclined downward in the width direction toward the connecting unit. The agitating wing may include a first wing portion and a second wing portion adjacent to the connecting unit, and a length of the second wing portion in the radial direction may be greater than a length of the first wing portion in the radial direction.

In the electrophotographic image forming apparatus, the at least one developing device is a black developing device for developing a black toner image.

Exemplary embodiments of the present general inventive concept can also provide an electrophotographic image forming apparatus including a first and second photosensitive bodies, and first and second developing devices to develop electrostatic latent images formed on the first and second photosensitive bodies, each of the first and second developing devices including a first toner containing unit to contain a toner, the second developing device further including a second toner containing unit connected to the first toner containing unit by a connection unit.

The electrophotographic image forming apparatus may further include a transfer medium to which toner images formed on the first and second photosensitive bodies are transferred, where the first and second toner containing units may be disposed on upstream and downstream regions in a proceeding direction of the transfer medium, respectively.

The first and second developing devices may include respective optical paths on which light for exposing the first and second photosensitive bodies is incident, where the optical path of the second developing device may be disposed between the first and second toner containing units of the second developing device.

A length of the second developing device in the proceeding direction may be greater than a length of the first developing device in the proceeding direction, and heights of the first and second developing devices may be equal to each other.

A bottom portion of the second toner containing unit may be inclined downward in a width direction toward the connecting unit, where an agitating member may be installed in the second toner containing unit to supply a toner to the first toner containing unit through the connecting unit, the agitating member includes a rotation axis that extends in the width direction and an agitating ring that extends from the rotation axis in a radial direction, and the agitating wing may include a first wing portion and a second wing portion adjacent to the connecting unit, where a length of the second wing portion in the radial direction is greater than a length of the first wing portion in the radial direction.

The at least one developing device may be a black developing device for developing a black toner image.

Exemplary embodiments can also provide a developing device including a developing unit to supply a toner to an electrostatic latent image formed on an photosensitive body and developing the electrostatic latent image, a first toner containing unit that is disposed in one side with respect to an optical path of light irradiated to the photosensitive body and contains a toner to be supplied to the developing unit, a second toner containing unit that is disposed in another side with respect to the optical path and contains a toner, and a connecting unit to connect the first and second toner containing units.

The developing unit may be disposed on a downstream region from the first toner containing unit with respect to a proceeding direction of the light.

A waste toner containing unit to contain waste toner removed from the photosensitive body may be disposed in the other side, and the waste toner containing unit may be disposed on a downstream region from the second toner containing unit with respect to the proceeding direction of the light. The connecting unit may be disposed outside an effective width of the optical path.

A bottom portion of the second toner containing unit may be inclined downwardly toward the connection unit.

The second toner containing unit may include an agitating member for agitating a toner toward a supplying path of the toner.

The agitating member may include a rotation axis that extends in a width direction of the second toner containing unit and an agitating wing disposed on the rotation axis, where the agitating wing may include a first wing portion and a second wing portion adjacent to the connecting unit, and a length of the second wing portion in a radial direction may be greater than a length of the first wing portion in the radial direction.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
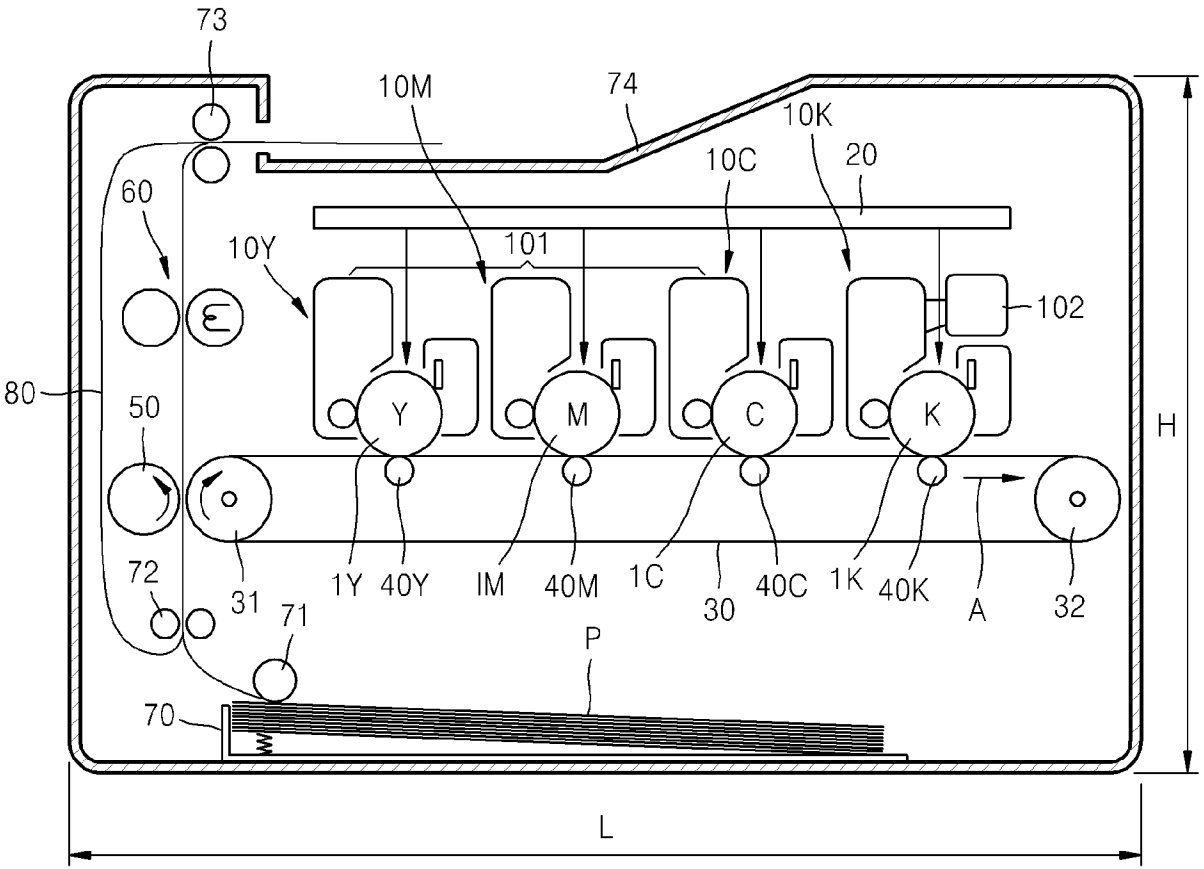
FIG. 1 is a schematic structural view illustrating an electrophotographic image forming apparatus according to exemplary embodiments of the present general inventive concept.

Hereinafter, a developing device and an electrophotographic image forming apparatus including the developing device will be described with regard to exemplary embodiments of the invention with reference to the attached drawings. As used herein, the term "and/or" includes any and all combinations of one or more of the associated listed items.

Reference will now be made in detail to the embodiments of the present general inventive concept, examples of which are illustrated in the accompanying drawings, where like reference numerals refer to the like elements throughout. The embodiments are described below in order to explain the present general inventive concept while referring to the figures.

FIG. 1 is a schematic structural view illustrating an electrophotographic image forming apparatus according to exemplary embodiments of the present general inventive concept. The electrophotographic image forming apparatus can be an electrophotographic color image forming apparatus to print a color image by using an electrophotographic method.

FIG. 1 illustrates a plurality of photosensitive drums 1Y, 1M, 1C, and 1K, a plurality of developing devices 10Y, 10M, 10C, and 10K, and an intermediate transfer belt 30. Each photosensitive drum 1 is, for example, a photosensitive body having a surface on which an electrostatic latent image is formed and may include a conductive metal pipe and a photosensitive layer formed on an outer circumferential surface thereof. Hereinafter, the photosensitive drums 1Y, 1M, 1C, and 1K may be collectively referred to as the photosensitive drums 1 and the developing devices 10Y, 10M, 10C, and 10K may be collectively referred to as the developing devices 10.

The developing devices 10 may respectively correspond to the photosensitive drums 1. Each developing device 10 may form a toner image on a surface of the photosensitive drum 1 by supplying and developing toner to an electrostatic latent image formed on the photosensitive drum 1. Each of the developing devices 10 may be replaced with a new developing device, without replacing the photosensitive drums 1. In addition, the developing devices 10 may be cartridges respectively including the photosensitive drums 1.

In order to print a color image, the developing devices 10 may include the developing device 10Y to contain a toner of yellow (Y), the developing device 10M to contain a toner of magenta (M), the developing device 10C to contain a toner of cyan (C), and the developing device 10K to contain a toner of black (K). However, the exemplary embodiments of the present general inventive concept are not limited to this case and thus the developing devices 10 may include developing devices to contain various colors such as light magenta, white, or the like in addition to the above-described colors. Further, according other exemplary embodiments of the present general inventive concept, the developing devices 10 may include developing devices to contain various colors such as light magenta, white, or the like instead of one or more of the above-described colors. For example, the developing devices 10 may include a developing device to contain a toner for yellow, a developing device to contain a toner for magenta, a developing device to contain a toner for white, and a developing device to contain a toner for black. Hereinafter, a case where the electrophotographic image forming apparatus includes the developing devices 10Y, 10M, 10C, and 10K will be described. Unless otherwise indicated herein, elements marked together with Y, M, C, and K refer to elements for printing images by using toners of Y, M, C, and K colors, respectively.

An exposer 20 may respectively form electrostatic latent images corresponding to images of Y, M, C, and K on the photosensitive drums 1Y, 1M, 1C, and 1K by irradiating light that is modulated to correspond to image information to the photosensitive drums 1Y, 1M, 1C, and 1K, which will be described later. Examples of the exposer 20 may include a laser scanning unit (LSU) using a laser diode as a light source, a light emitting diode (LED) exposer using an LED as a light source, and the like.

The intermediate transfer belt 30 is an example of a transfer medium. Toner images of Y, M, C, and K respectively developed on the photosensitive drums 1Y, 1M, 1C, and 1K are temporally accommodated on the intermediate transfer belt 30 prior to being transferred to a recording medium P. The intermediate transfer belt 30 may be supported by, for example, supporting rollers 31 and 32 and may rotate around the supporting rollers 31 and 32.

A plurality of first transfer rollers 40Y, 40M, 40C, and 40K are arranged to respectively face the photosensitive drums 1Y, 1M, 1C, and 1K, where the intermediate transfer belt 30 is interposed between the photosensitive drums 1Y, 1 M, 1C, and 1K and the first transfer rollers 40. The first transfer rollers 40 are, for example, first transferring devices to transfer the toner images to the intermediate transfer belt 30 from the photosensitive drums 1Y, 1M, 1C, and 1K, respectively. An intermediate transfer bias voltage is applied to the first transfer rollers 40 by a power supply (not illustrated) so as to transfer the toner images developed on the photosensitive drums 1 to the intermediate transfer belt 30. The first transfer rollers 40Y, 40M, 40C, and 40K and the photosensitive drums 1Y, 1M, 1C, and 1K may be in pressing contact to each other, respectively, with the intermediate transfer belt 30 disposed therebetween. Instead of the first transfer rollers 40, a corona transferring device or a pin scorotron transferring device may be used.

A second transfer roller 50 is an example of a second transferring device to transfer the toner images from the intermediate transfer belt 30 to the recording medium P. The second transfer roller 50 may be disposed to face the supporting roller 31, where the intermediate transfer belt 30 is disposed between the second transfer roller 50 and the supporting roller 31. A transfer bias voltage is applied to the second transfer roller 50 by the power supply so as to transfer the toner images transferred to the intermediate transfer belt 30 to the recording medium P. The second transfer roller 50 and the supporting roller 31 may be in pressing contact to each other, with the intermediate transfer belt 30 disposed therebetween. Instead of the second transfer roller 50, a corona transferring device or a pin scorotron transferring device may be used.

A pickup roller 71 may pick up the recording medium P on a sheet-by-sheet basis from a loading board 70. A set of feed rollers 72 may feed the recording medium P to a transfer region where the second transfer roller 50 and the intermediate transfer belt 30 face each other.

The electrophotographic image forming apparatus of FIG. 1 transfers the toner images developed on the photosensitive drums 1Y, 1M, 1C, and 1K to the intermediate transfer belt 30 and then transfers the toner images to the recording medium P passing between the intermediate transfer belt 30 and the second transfer roller 50. However, the present general inventive concept is not limited to this case. Alternatively, the toner images may be directly transferred from the photosensitive drums 1Y, 1M, 1C, and 1K, respectively, to the recording medium P, without using the intermediate transfer belt 30. In this case, the second transfer roller 50 may not be equipped, a paper moving belt (not illustrated) to move the recording medium P while maintaining the recording medium P on a surface thereof by an electrostatic force may be used instead of the intermediate transfer belt 30, and the recording medium P may be a transfer medium.

A fuser 60 fuses an image transferred to the recording medium P by applying heat and/or pressure to the image. A shape of the fuser 60 is not limited to FIG. 1. The recording medium P passing through the fuser 60 is discharged by a discharge roller 73.

Figure 2:
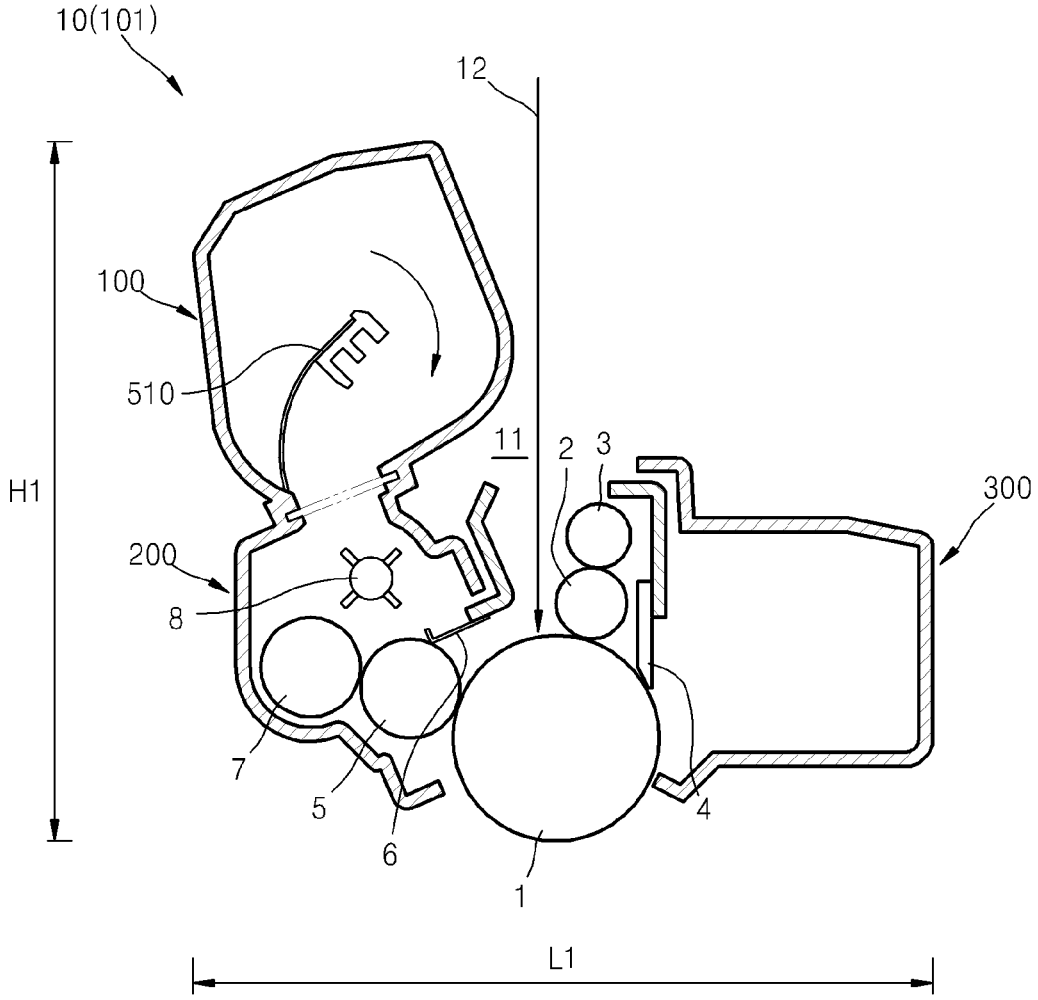
FIG. 2 is a cross-sectional view illustrating a detailed structure of a developing device, according to exemplary embodiments of the present general inventive concept.

FIG. 2 is a cross-sectional view illustrating a detailed structure of a developing device 10, according to exemplary embodiments of the present general inventive concept. Referring to FIG. 2, the developing device 10 may include a first toner containing unit 100, a developing unit 200, and a waste toner containing unit 300.

The first toner containing unit 100 may contain toner to provide to the developing unit 200. The developing unit 200 forms a toner image by supplying toner provided by the first toner containing unit 100 to an electrostatic latent image formed on a photosensitive drum 1. The waste toner containing unit 300 contains waste toner, impurities, or the like that is removed from a surface of the photosensitive drum 1.

A developing roller 5 may be installed in the developing unit 200. The developing roller 5 supplies toner contained in the developing device 10 to the photosensitive drum 1. A developing bias voltage may be applied to the developing roller 5 by the power supply. A regulating member 6 regulates the amount of toner supplied to a developing region where the photosensitive drum 1 and the developing roller 5 face each other by the developing roller 5.

When a dual-component developing method is used, a magnetic carrier and a toner are contained in the developing device 10, and the developing roller 5 is spaced apart from the photosensitive drum 1 by, for example, several tens to several hundreds of microns. Although not illustrated in FIG. 2, the developing roller 5 may be a magnetic roller. Also, the developing roller 5 may include a developing sleeve and a magnetic roller disposed in the developing sleeve. The toner in the developing device 10 is attached to a surface of the magnetic carrier. The magnetic carrier with the toner attached thereto is attached to a surface of the developing roller 5 and is moved to the developing region where the photosensitive drum 1 and the developing roller 5 face each other. Only the toner is supplied from the developing roller 5 to the photosensitive drum 1 without the magnetic carrier by the developing bias voltage applied between the developing roller 5 and the photosensitive drum 1 by the power supply, and thus the electrostatic latent image formed on the surface of the photosensitive drum 1 is developed to a visible toner image. When a monocomponent developing method is used, the developing roller 5 may contact the photosensitive drum 1 and rotate. Alternatively, while the developing roller 5 rotates, the developing roller 5 may be spaced apart from the photosensitive drum 1 by, for example, several tens to several hundreds of microns.

A supplying roller 7 to attach toner to the surface of the developing roller 5 may be installed in the developing unit 200. A supplying bias voltage may be applied to the supplying roller 7 by the power supply. An agitator 8 may be installed in the developing unit 200. The agitator 8 may agitate the toner to charge the toner with triboelectricity and may move the toner toward the supplying roller 7. An example of the agitator 8 may include a paddle.

When a dual-component developing method is used, the agitator 8 may mix and agitate the toner contained in the developing unit 200 with the magnetic carrier, and may move the mixture of the toner and the magnetic carrier to the developing roller 5. In this case, the agitator 8 may be an auger to move the toner and the carrier in a widthwise direction W (see FIG. 5B) of the developing device 10 and the developing unit 200 may include a plurality of agitators 8.

A charging roller 2 charges the photosensitive drum 1 to have a uniform surface potential. Instead of the charging roller 2, a charging brush, a corona charger, or the like may be used. A charging roller cleaner 3 removes impurities such as toner, dust, or the like attached to a surface of the photosensitive drum 1, the charging roller 2, and the like.

A cleaning blade 4 removes waste toner and impurities that remain on the surface of the photosensitive drum 1 after an intermediate transfer process is performed. Instead of the cleaning blade 4, a different type of cleaning device such as a rotatable brush or the like may be used. Waste toner and impurities removed from the surface of the photosensitive drum 1 are contained in the waste toner containing unit 300.

With respect to light 12 irradiated from the exposer 20 to the photosensitive drum 1, the developing unit 200 and the first toner containing unit 100 are disposed at one side (e.g., a left side), and the waste toner containing unit 300 is disposed at another side (e.g., a right side). Thus, an optical path 11 through which the light 12 passes is formed between a set of the developing unit 200 and the first toner containing unit 100, and the waste toner containing unit 300. The optical path 11 extends in a vertical direction. The light 12 is irradiated from above the photosensitive drum 1. The first toner containing unit 100 may be disposed above the developing unit 200 with respect to the direction of gravity so that toner may be smoothly supplied from the first toner containing unit 100 to the developing unit 200 by gravity. With respect to a proceeding direction of the light 12, the developing unit 200 is disposed on a region downstream from the first toner containing unit 100. By disposing the first toner containing unit 100 above the developing unit 200, the amount of toner contained in the first toner containing unit 100 may be increased without increasing a length L of the electrophotographic image forming apparatus, as such arrangement of the first toner containing unit 100 does not increase a length L1 of the developing device 10. A first agitating member 510 may be installed in the first toner containing unit 100 so as to agitate toner and to supply the toner to the developing unit 200.

Thus far, an example of a developing method of an image forming apparatus according to an embodiment of the present general inventive concept has been described. However, the present general inventive concept is not limited to this case. The developing method may be modified and changed in various ways.

By the above-described structure, the exposer 20 may respectively scan a plurality of light beams modulated to correspond to image information of colors to the photosensitive drums 1Y, 1M, 1C, and 1K to form electrostatic latent images. The developing devices 10Y, 10M, 10C, and 10K may respectively supply toners of Y, M, C, and K to the electrostatic latent images formed on the photosensitive drums 1Y, 1M, 1C, and 1K to respectively form visible toner images of Y, M, C, and K on the photosensitive drums 1Y, 1M, 1C, and 1K. The toner images of Y, M, C, and K are sequentially transferred to the intermediate transfer belt 30 by the intermediate transfer bias voltage applied to the first transfer rollers 40 by the power supply. The recording medium P loaded on the loading board 70 is moved between the second transfer roller 50 and the intermediate transfer belt 30 by the pickup roller 71 and the moving roller 72. The toner images of Y, M, C, and K transferred to the intermediate transfer belt 30 are transferred to the recording medium P by a transfer bias voltage applied to the second transfer roller 50 by the power supply. When the recording medium P passes through the fuser 60, the toner images are fused onto the recording medium P by heat and pressure. The recording medium P on which the toner images are completely fused is discharged to a tray 74 by the discharge roller 73 from the fuser 60. When duplex printing is performed, the recording medium P, after having passed through the fuser 60 to print an image on one surface of the recoding medium P, is guided to a duplex printing path 80. Thus, the recording medium P is supplied between the intermediate transfer belt 30 and the second transfer roller 50 again. Another image is transferred to a rear surface of the recording medium P as the recording medium P passes between the intermediate transfer belt 30 and the second transfer roller 50 again. The recording medium P is discharged to the tray 74 by the discharge roller 73 after having been passed through the fuser 60 again to fuse the toner images on the rear surface of the recording medium P.

Different colors of toners are contained in the first toner containing units 100 of the developing devices 10Y, 10M, 10C, and 10K, respectively. When the toners are exhausted, the toners need to be refilled. The toner of each developing device 10 may be refilled by supplying the toner to the first toner containing unit 100, or changing only the first toner containing unit 100, or changing the developing device 10 itself, or the like.

Figure 3:
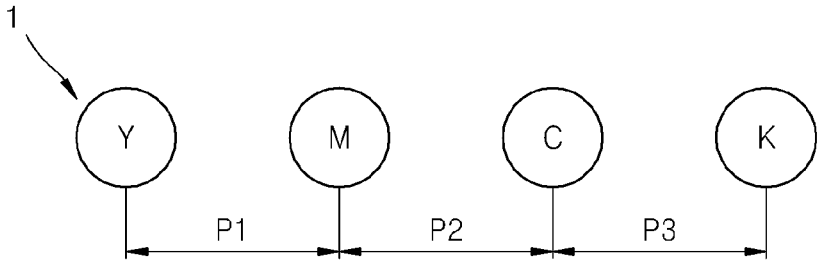
FIG. 3 is a diagram illustrating intervals between a plurality of photosensitive drums, according to exemplary embodiments of the present general inventive concept.

With regard to a color image forming apparatus, one color may be more frequently used than other colors. For example, a text document of a single color (e.g., a black color) may be more frequently printed. That is, if a toner of the black color is used most frequently in printing, the toner of the developing device 10K is refilled most frequently, and thus a replacement cycle of the developing device 10K is the shortest from among the developing devices 10Y, 10M, 10C, and 10K. In order to increase the replacement cycle of the developing device K, the size of the developing device 10K needs to be increased so as to contain as large an amount of black toner as possible. For example, the amount of black toner contained in the first toner containing unit 100 may be increased by extending the first toner containing unit 100 of the developing device 10K upward or in a longitudinal direction. However, in this case, a height H or the length L of the image forming apparatus may be increased due to the increased size of the first toner containing unit 100 of the developing device 10. With regard to a single-path type color image forming apparatus illustrated in FIG. 1, toners of Y, M, C, and K are sequentially developed and transferred. When an interval P1 between the photosensitive drums 1Y and 1M, an interval P2 between the photosensitive drums 1M and 1C, and an interval P3 between the photosensitive drums 1C, and 1K are equal to one another, as illustrated in FIG. 3, a point of time to begin development and transfer of the toners to the intermediate transfer belt 30 can be controlled. However, when the first toner containing unit 100 of the developing device 10K is extended in a longitudinal direction, the interval P3 between the photosensitive drums 1C and 1K may be greater than each of the interval P1 between the photosensitive drums 1M and 1C and the interval P2 between the photosensitive drums 1M, and 1C, and thus it may be complicated to control a point of time to begin development and transfer of the toner to the intermediate transfer belt 30. Thus, there is a need for increasing a capacity to contain the toner in the developing device 10K while minimizing the size of the image forming apparatus. In addition, there is a need for increasing a capacity to contain the toner in the developing device 10K while maintaining the intervals P1, P2, and P3 between the photosensitive drums 1Y, 1M, 1C, and 1K to be equal to one another.

Hereinafter, the developing devices 10Y, 10M, and 10C will be referred to as first developing devices 101 and the developing device 10K will be referred to as a second developing device 102 in order to differentiate the developing devices 10Y, 10M, and 10C, and the developing device 10K. Similarly, the photosensitive drums 1Y, 1M, and 1C may be referred to as first photosensitive drums, and the photosensitive drum 1K may be referred to as a second photosensitive drum.

The first developing device 101 has the same structure as that illustrated in FIG. 2. The second developing device 102 may be disposed on a region downstream from the first developing device 101 with respect to a proceeding direction A of the intermediate transfer belt 30. That is, as illustrated in FIG. 1, the second developing device 102 is disposed on a most downstream region with respect to the proceeding direction A.

Figure 4A:
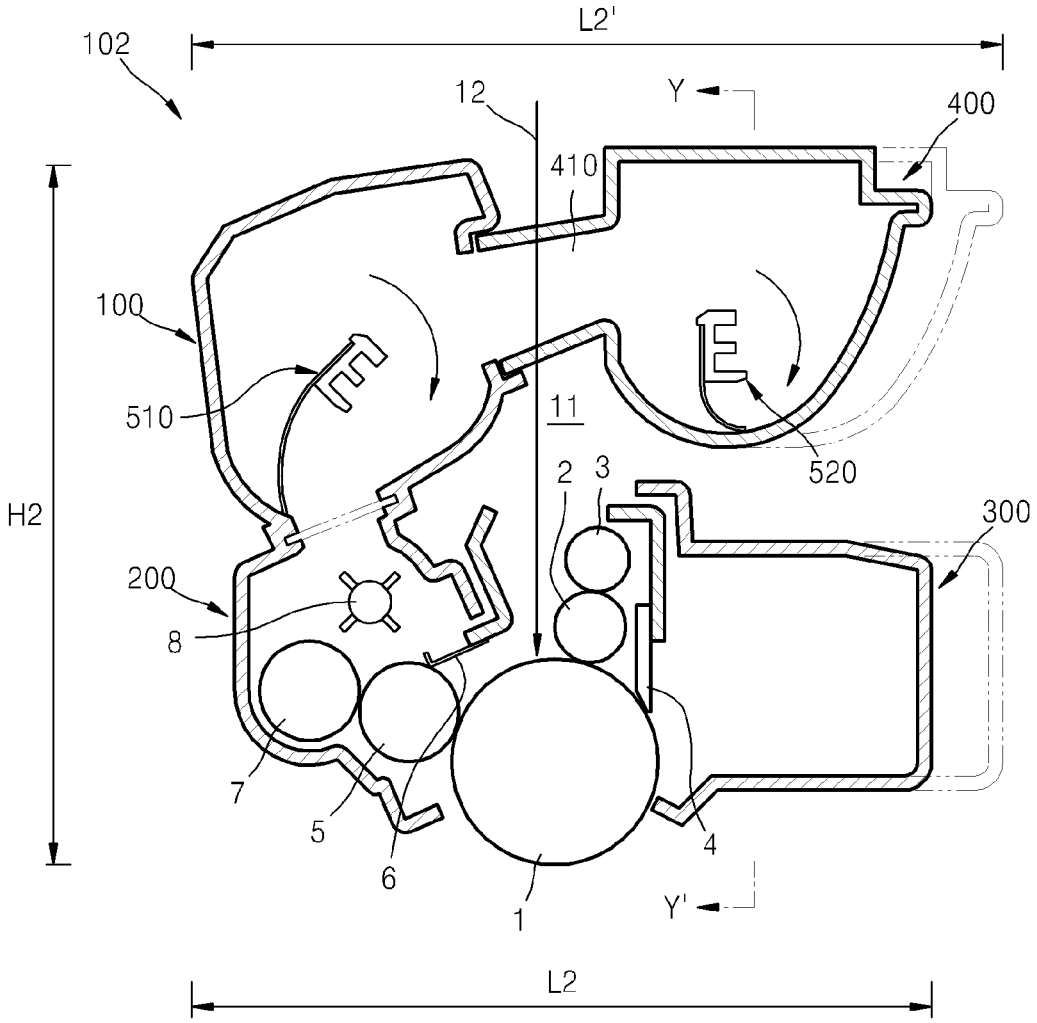
FIGS. 4A-4B are cross-sectional views illustrating a detailed structure of a second developing device, according to exemplary embodiments of the present general inventive concept.
Figure 4B:
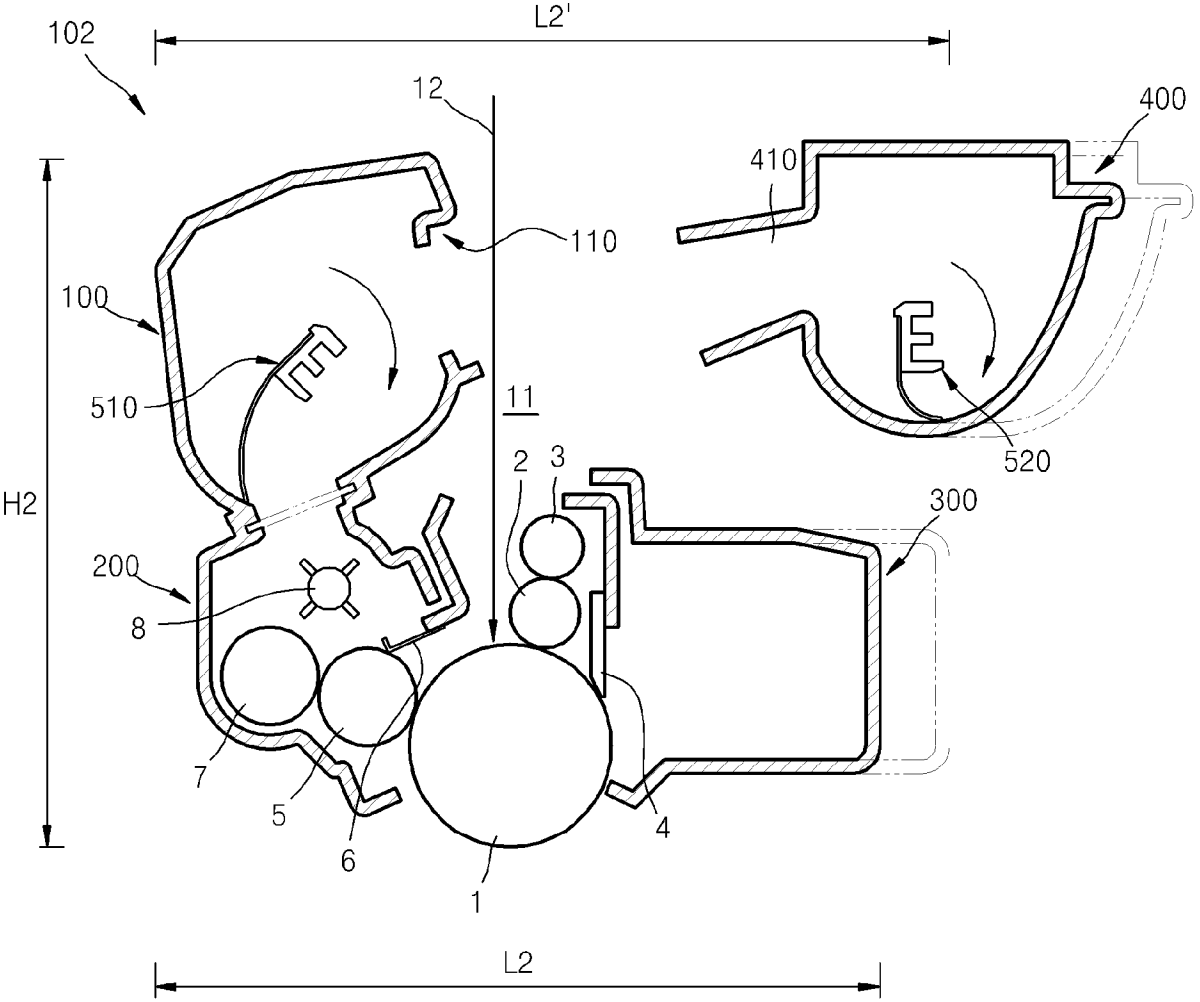

An example of a structure of the second developing device 102 is illustrated in FIGS. 4A and 4B. The structure of the second developing device 102 of FIG. 4A may be the same as the structure of the first developing device 101 of FIG. 2, except that the second developing device 102 of FIG. 4A further includes a second toner containing unit 400 and a connecting unit 410 to connect the second toner containing unit 400 and the first toner containing unit 100. As illustrated in FIG. 4A, with respect to the optical path 11, the second toner containing unit 400 is disposed at the other side, that is, a side opposite to the first toner containing unit 100. Toner is contained in the second toner containing unit 400. The second toner containing unit 400 is disposed above the waste toner containing unit 300. That is, with respect to the proceeding direction of the light 12, the waste toner containing unit 300 is disposed on a region downstream from the second toner containing unit 400. By this structure, the second toner containing unit 400 may be disposed in a space above the waste toner containing unit 300, thereby increasing the amount of toner contained in the second developing device 102 without increasing the length (which corresponds to 'L' of FIG. 1) of the image forming apparatus. The second toner containing unit 400 is disposed such that the height of the second toner containing unit 400 is substantially equal to the height of the first toner containing unit 100, and thus the height H2 is not increased by the second toner containing unit 400.

Figure 5A:
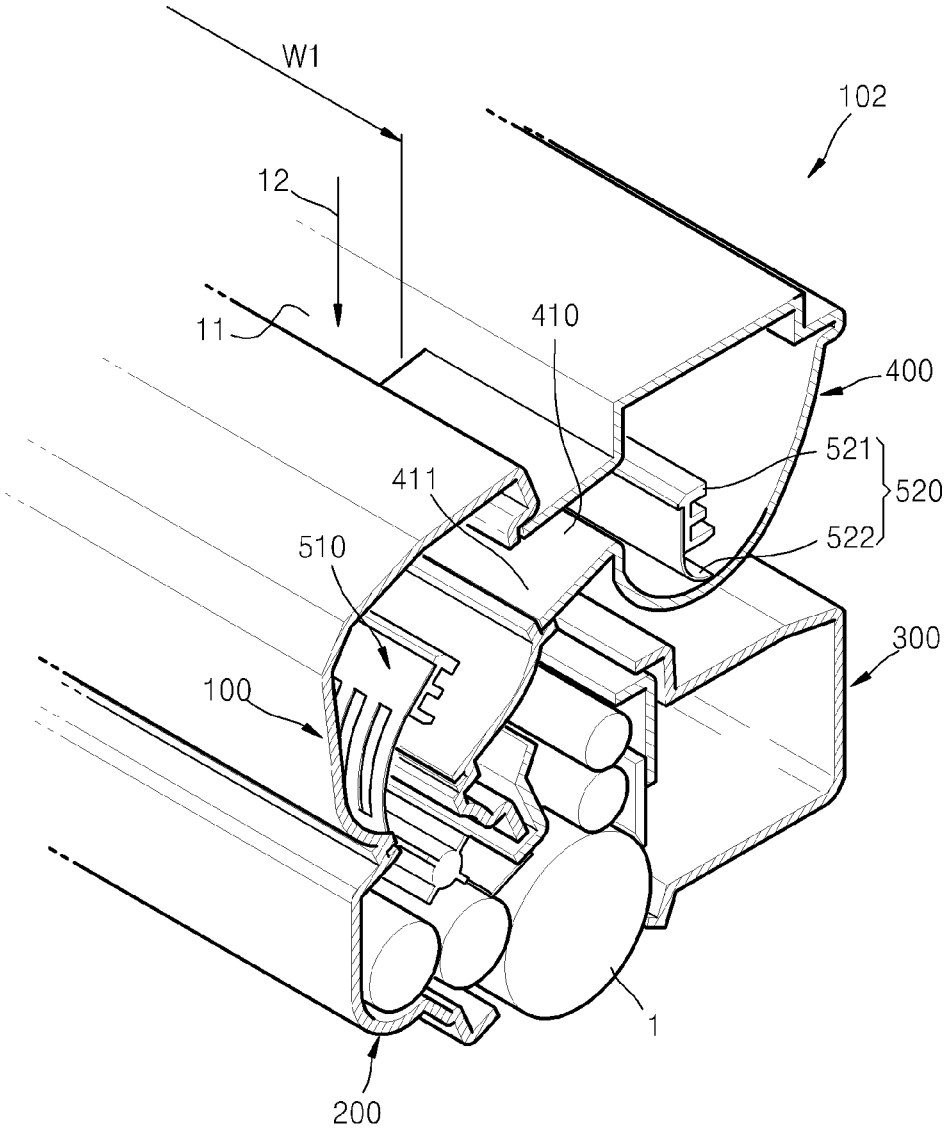
FIG. 5A is a partial perspective view illustrating the shape of a connecting unit of a second toner containing unit and FIG. 5B is a partial perspective view illustrating a first toner containing unit without the second toner containing unit attached thereto, according to exemplary embodiments of the present general inventive concept.
Figure 6:
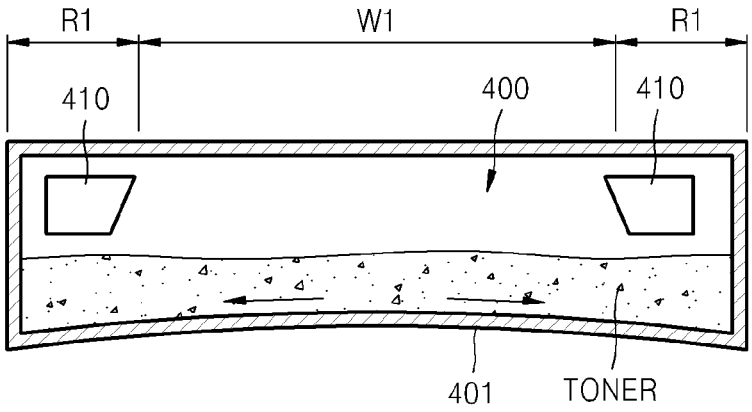
FIG. 6 is a cross-sectional view illustrating a bottom portion of a second toner containing unit, according to exemplary embodiments of the present general inventive concept.
Figure 8:
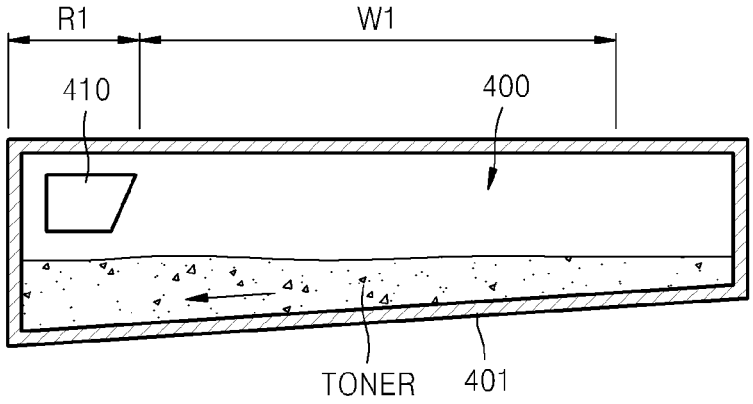
FIG. 8 is a cross-sectional view illustrating a bottom portion of a second toner containing unit according to exemplary embodiments of the present general inventive concept.

Toner contained in the second toner containing unit 400 is supplied to the first toner containing unit 100 through the connecting unit 410. FIG. 5A is a partial perspective view to illustrate the shape of the connecting unit 410, according to an embodiment of the present general inventive concept. As illustrated in FIG. 5A, the connecting unit 410 is disposed in a region outside an effective width W1 of the optical path 11. For example, connecting units 410 may be disposed in two regions outside the effective width W1 of the optical path 11 (as illustrated in FIG. 6). Alternatively, the connecting unit 410 may be disposed on only one region outside the effective width W1 of the optical path 11 (as illustrated in FIG. 8). A second agitating member 520 may be installed in the second toner containing unit 400. The second agitating member 520 may include a rotation axis member 521 with a rotation axis 521a and an agitating wing 522 that extends in a radial direction of the rotation axis member 521. The agitating wing 522 may be made of a flexible material, so has, for example, a flexible film type of material. A length of the agitating wing 522 in the radial direction is determined such that the agitating wing 522 may flexibly contact an inner wall of the second toner containing unit 400 so as to move the toner in the second toner containing unit. The rotation axis member 521 extends in a width direction of the second toner containing unit 400. When the second agitating member 520 rotates, toner contained in the second toner containing unit 400 may be moved to the first toner containing unit 100 through the connecting unit 410 by the agitating wing 522. In order to easily supply the toner from the second toner containing unit 400 to the first toner containing unit 100, at least a bottom portion 411 of the connecting unit 410 may be inclined downwards in a direction from the second toner containing unit 400 toward the first toner containing unit 100.

The second agitating member 520 including the agitating wing 522, which extends from the rotation axis 521 in the radial direction, moves the toners contained in the second toner containing unit 400 in a longitudinal direction of the second toner containing unit 400, but does not move the toner in a width direction of the second toner containing unit 400. Thus, there is a need for moving toner in the width direction in the second toner containing unit 400 so that the toner in the second toner containing unit 400 is in a location that corresponds to the connecting unit 410 (e.g., a location of the second toner containing unit 400 adjacent to the connecting unit 410). To achieve this, a separate mover may be disposed in the second toner containing unit 400 to move the toner in the width direction of the second toner containing unit 400. However, according to the exemplary embodiments of the present general inventive concept, the toner may be moved in the width direction by the shape of the second toner containing unit 400 without using any separate mover, as described below.

FIG. 4B illustrates an exemplary embodiment of the second developing device 102, where the second toner containing unit 400 is detachable from the first toner containing unit 100. In this embodiment, one end of the connecting unit 410 facing with an opening may be detachably connected to the first toner containing unit 100. When the second toner containing unit 400 is detached from the first toner containing unit 100, the second developing device 102 may have the same structure as the first developing device 101, having only the first toner containing unit 100. Thus, the image forming apparatus may be provided with developing devices with only the first toner containing units 100, where each of the first toner containing units 100 can receive the second toner containing unit 400 via a receiving portion 110 to attach the second toner containing unit 400. The second toner containing unit 400 may be attached or detached to the first toner containing unit 100, depending on whether the color of the toner for the developing device is frequently used. For example, if it is determined that yellow color is used frequently, then a user can attach a second toner containing unit 400 for the yellow color to the first toner containing unit 100 in the developing device 10Y for the yellow color. This provides flexibility by enabling a user to vary toner container capacities for different colors, depending on which color is more used. The receiving portion 110 of the first toner containing unit 100 and the connecting portion 410 of the second toner containing unit 400 may be provided with an engaging mechanism (e.g., a notch and a groove) to firmly engage the second toner containing unit 400 with the first toner containing unit 100.

Figure 5B:
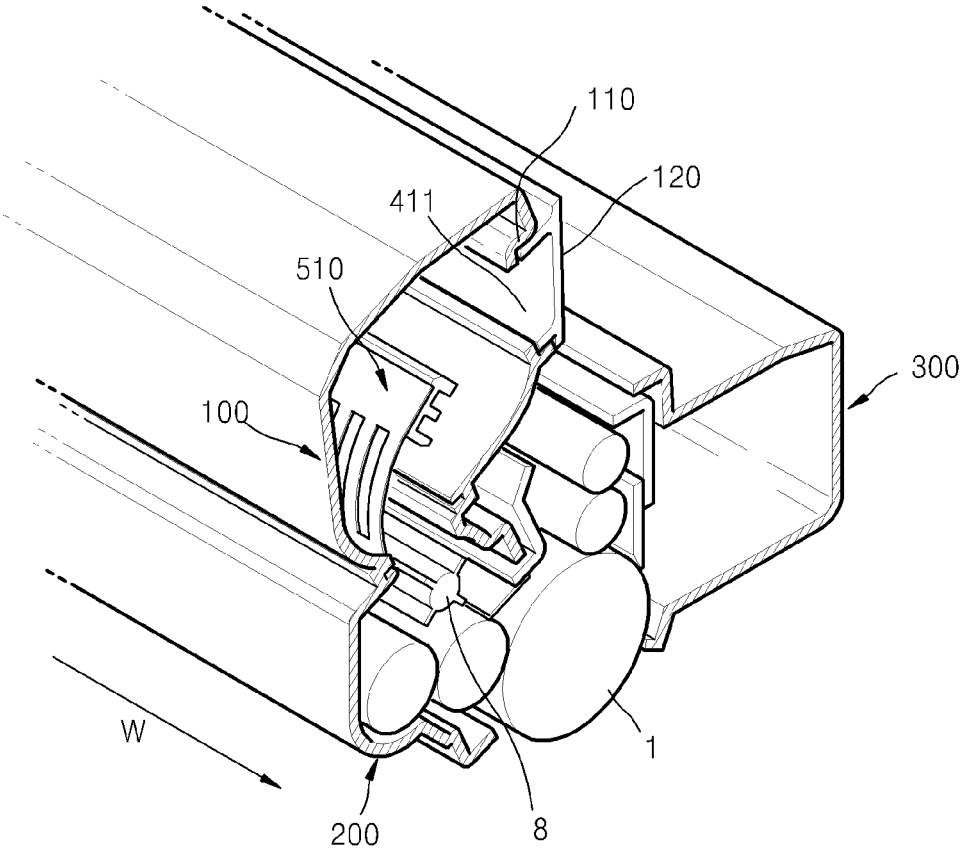

FIG. 5B is a partial perspective view illustrating a first toner containing unit without the second toner containing unit attached thereto. FIG. 5B may be an exemplary embodiment of the second developing device 102 with the second toner containing unit 400 detached from the first toner containing unit 100. Also, FIG. 5B may be an exemplary embodiment of the first developing device 101 having only the first toner containing unit 100. As described above, the first toner containing unit 100 and the developing unit 200 disposed under the first toner containing unit 100 are disposed in one side, and the waste toner containing unit 300 is disposed in the other side, and the photosensitive drum 1 is disposed between the developing unit 200 and the waste toner containing unit 300. The first toner containing unit 100 has the first agitating member 510 to agitate toner and to supply the toner to the developing unit 200. The first toner containing unit 100 may have the receiving portion 110 to receive a connecting portion 410 of the second toner containing unit 400 to attach the second toner containing unit 400 to the first toner containing unit 100. When the second toner containing unit 400 is not used, a cap 120 may be placed to cover the receiving portion 110. The developing unit 200 has the agitator 8 that may be an auger to move the toner and the carrier in a widthwise direction W of the developing device.

Figure 7:
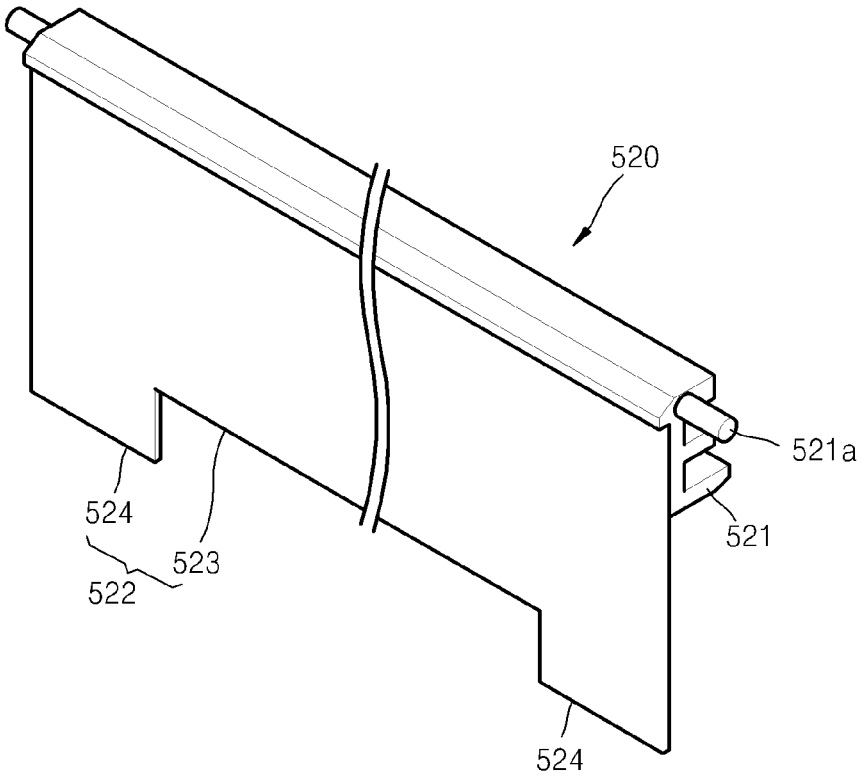
FIG. 7 is a perspective view illustrating a second agitating member according to exemplary embodiments of the present general inventive concept.

FIG. 6 illustrates a cross-sectional view of the second toner containing unit 400 taken along a line Y-Y' of FIG. 4A, according to an embodiment of the present general inventive concept. Referring to FIG. 6, connecting units 410 are disposed in two regions R1 and R1 outside the effective width W1 of the optical path 11. In this case, the bottom portion 401 of the second toner containing unit 400 is inclined downward from a central portion thereof toward two lateral portions corresponding to the two regions R1 and R1, that is, toward the connecting units 410. When the second agitating member 520 rotates in the second toner containing unit 400, the toner may flow via the second toner containing unit 400. Toner is a very small particle and may have high liquidity. Thus, the toner that flows due to the second agitating member 520 may flow toward the two lateral portions where the connection units 410 are positioned, according to the inclination of the bottom portion 401 and a force of gravity. Since toner has high fluidity, the toner may easily flow toward the two lateral portions by using only a small inclination, such as an inclination of about 2 to about 3 mm from the central portion. The inclination of the bottom portion 401 may be shaped like a straight line shape or a curve line shape. By this structure, when the connecting units 410 are disposed in the two lateral portions of the second toner containing unit 400, toner contained in the second toner containing unit 400 may be easily moved to the first toner containing unit 100 through the connecting units 410 by using the second agitating member 520 including the agitating wing 522 extending from the rotation axis member 521 in the radial direction. Referring to FIG. 7, the agitating wing 522 may include a first wing portion 523 and a second wing portion 524 next to the connecting units 410 to correspond with the connecting units 410, respectively. The length of the second wing portion 524 in the radial direction is greater than the length of the first wing portion 523 in the radial direction. Thus, toner may be easily supplied to the connecting unit 410 while maintaining a low rotation load of the second agitating member 520.

Figure 9:
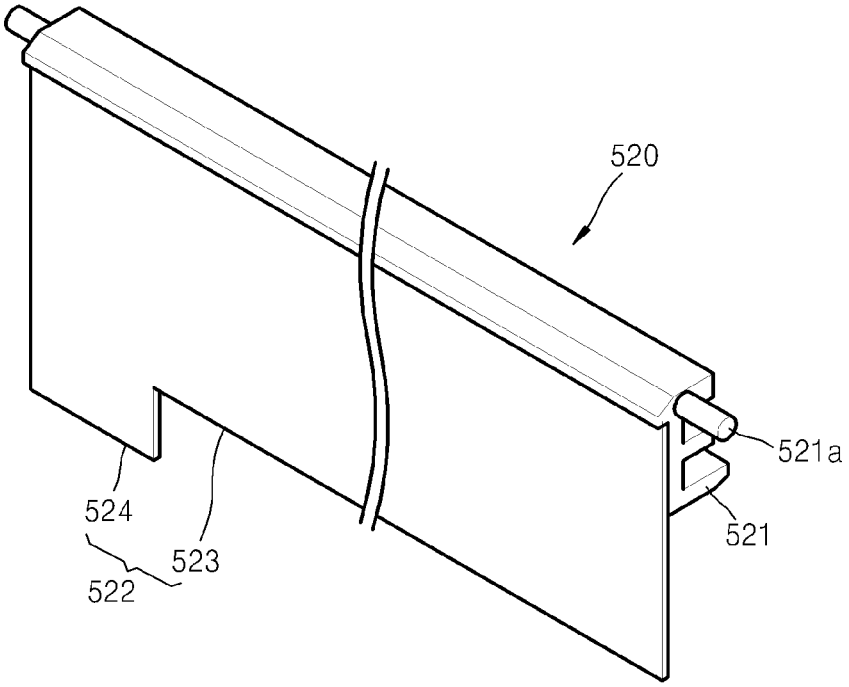
FIG. 9 is a perspective view illustrating a second agitating member according to exemplary embodiments of the present general inventive concept.

In exemplary embodiments of the present general inventive concept illustrated in FIG. 8, when the connecting unit 410 is disposed in one lateral portion R1 only, the bottom portion 401 may be inclined downward from the other lateral portion toward the connecting unit 410. In addition, as illustrated in FIG. 9, the second agitating member 520 may be configured such that the second wing portion 524 may be formed in one region only.

The volume of the waste toner containing unit 300 may be smaller than the volume of the first toner containing unit 100. With respect to the optical path 11, when the first toner containing unit 100 and the developing unit 200 disposed under the first toner containing unit 100 are disposed in one side, and the waste toner containing unit 300 is disposed in the other side, the waste toner containing unit 300 may occupy a space at almost the same level as the developing unit 200 in a vertical direction. Thus, a space above the waste toner containing unit 300, that is, a space next to the first toner containing unit 100, may correspond to a spare space. According to the exemplary embodiments of the present general inventive concept, the second toner containing unit 400 is disposed in the spare space and is connected to the first toner containing unit 100 by the connecting unit 410, thereby increasing the amount of toner contained in the second developing device 102 without increasing the size of the image forming apparatus. For example, when the second toner containing unit 400 is formed such that a length L1 (refer to FIG. 2) of the first developing device 101 may be equal to a length L2 of the second developing device 102, the total length L (refer to FIG. 1) of the image forming apparatus is not changed by the second toner containing unit 400. In addition, when a height H1 (refer to FIG. 1) of the first developing device 101 is equal to a height H2 (refer to FIG. 4A) of the second developing device 102 including the second toner containing unit 400, the total height H (refer to FIG. 1) of the image forming apparatus is not changed by the second toner containing unit 400.

In exemplary embodiments of the present general inventive concept, in order to further increase the amount of toner contained in the second toner containing unit 400, the second toner containing unit 400 may further extend in a longitudinal direction, as indicated by dotted lines of FIG. 4A. That is, a length L2' of the second developing device 102 may be greater than the length L1 (refer to FIG. 2) of the first developing device 101. In this case, a position of the photosensitive drum 1K is not changed and only the second toner containing unit 400 extends in the longitudinal direction. That is, since the second developing device 102 is disposed on a region downstream from the first developing device 101 with respect to the proceeding direction A of the intermediate transfer belt 30, although the position of the second toner containing unit 400 extends in the longitudinal direction, the position of the photosensitive drum 1K may not be changed. Thus, as illustrated in FIG. 3, the intervals P1, P2, and P3 between the photosensitive drums 1Y, 1M, 1C, and 1K may be maintained to be equal to each other. In this example, the waste toner containing unit 300 may be extended in a longitudinal direction, as indicated by dotted lines of FIG. 4A, to an extent that the second toner containing unit 400 is extended.

While the present general inventive concept has been particularly shown and described with reference to exemplary embodiments thereof, it will be understood by those of ordinary skill in the art that various changes in form and details may be made in these embodiments without departing from the spirit and scope of the present general inventive concept as defined by the following claims and their equivalents.

What is claimed is:

1. An electrophotographic image forming apparatus comprising:

a plurality of photosensitive bodies;

an exposer to irradiate light to each of the plurality of photosensitive bodies to form an electrostatic latent image; and a plurality of developing devices, each of the plurality of developing devices comprising a developing unit to supply a toner to the electrostatic latent image on a corresponding photosensitive body from among the plurality of photosensitive bodies to form a toner image and a first toner containing unit to contain a toner to be supplied to the developing unit, at least one developing device from among the plurality of developing devices comprising a second toner containing unit in connected to the first toner containing unit of the at least one developing device such that an optical path of light that is irradiated to a corresponding photosensitive body of the at least one developing device is disposed between the first and second toner containing units and connecting units disposed in two regions outside an effective width of the optical path to connect the first and second toner containing units of the at least one developing device such that the toner is transferred from the second toner containing unit to the first toner containing unit, wherein a bottom portion of the second toner containing unit is inclined downward in the width direction toward the connecting units.

2. The electrophotographic image forming apparatus of claim 1, further comprising an intermediate transfer belt that is disposed to face the plurality of photosensitive bodies and to which the toner image is transferred, wherein the at least one developing device is disposed on a most downstream region with respect to a proceeding direction of the intermediate transfer belt.

3. The electrophotographic image forming apparatus of claim 2, wherein pitches of the plurality of photosensitive bodies are equal to each other in the proceeding direction of the intermediate transfer belt.

4. The electrophotographic image forming apparatus of claim 2, wherein the second toner containing unit is disposed on a downstream region with respect to the proceeding direction, compared to the first toner containing unit of the developing unit of the at least one developing device.

5. The electrophotographic image forming apparatus of claim 4, wherein each of the plurality of developing devices comprises a waste toner containing unit to contain waste toner removed from the photosensitive bodies, and wherein the waste toner containing unit of the at least one developing device is disposed below the second toner containing unit.

6. The electrophotographic image forming apparatus of claim 2, wherein the plurality of developing devices have the same length in the proceeding direction.

7. The electrophotographic image forming apparatus of claim 2, wherein the plurality of developing devices have the same height.

8. The electrophotographic image forming apparatus of claim 2, wherein a length of the at least one developing device in the proceeding direction is greater than a length of the remaining developing devices in the proceeding direction.

9. The electrophotographic image forming apparatus of claim of 8, wherein the first toner containing units of the plurality of developing devices have the same length in the proceeding direction.

10. The electrophotographic image forming apparatus of claim of 8, wherein the plurality of developing devices have the same height.

11. The electrophotographic image forming apparatus of claim of 1, wherein an agitating member to supply toner to the first toner containing unit through the connecting unit is disposed in the second toner containing unit.

12. The electrophotographic image forming apparatus of claim of 11, wherein the agitating member comprises a rotation axis that extends in a width direction and an agitating wing that extends from the rotation axis in a radial direction.

13. The electrophotographic image forming apparatus of claim of 1, wherein the agitating wing comprises a first wing portion and a second wing portion adjacent to the connecting units, and wherein a length of the second wing portion in the radial direction is greater than a length of the first wing portion in the radial direction.

14. The electrophotographic image forming apparatus of claim of 1, wherein the at least one developing device is a black developing device for developing a black toner image.

15. An electrophotographic image forming apparatus comprising:

a first photosensitive body;

a second photosensitive body;

a first developing device to develop electrostatic latent images formed on the first photosensitive body, comprising a first toner containing unit to contain a toner; and a second developing device to develop electrostatic latent images formed on the second photosenstitive body comprising:

a first toner containing unit to contain a toner;

a second toner containing unit that contains a toner and is detachably connected to the first toner containing unit of the second developing device such that an optical path of light that is irradiated to the second photosensitive body is disposed between the first and second toner containing units; and connecting units disposed in two regions outside an effective width of the optical path to connect the second toner containing unit to the first toner containing unit of the second developing device such that the toner from the second toner containing unit is transferred to the first toner containing unit of the second developing device, wherein a bottom portion of the second toner containing unit is inclined downward in the width direction toward the connecting units.

16. The electrophotographic image forming apparatus of claim 15, further comprising a transfer medium to which toner images formed on the first and second photosensitive bodies are transferred, wherein the first and second toner containing units of the second developing device are disposed on upstream and downstream regions in a proceeding direction of the transfer medium, respectively.

17. The electrophotographic image forming apparatus of claim 16, wherein the first and second developing devices comprise respective optical paths on which light for exposing the first and second photosensitive bodies is incident, wherein the optical path of the second developing device is disposed between the first and second toner containing units of the second developing device.

18. The electrophotographic image forming apparatus of claim 17, wherein a length of the second developing device in the proceeding direction is greater than a length of the first developing device in the proceeding direction, and wherein heights of the first and second developing devices are equal to each other.

19. The electrophotographic image forming apparatus of claim 15, wherein an agitating member is installed in the second toner containing unit to supply a toner to the first toner containing unit of the second developing device through the connecting units, wherein the agitating member comprises a rotation axis that extends in the width direction and an agitating wing that extends from the rotation axis in a radial direction, and wherein the agitating wing comprises a first wing portion and a second wing portion adjacent to the connecting units, wherein a length of the second wing portion in the radial direction is greater than a length of the first wing portion in the radial direction.

20. The electrophotographic image forming apparatus of claim 15, wherein the second developing device is a black developing device for developing a black toner image.

21. A developing device comprising:

a developing unit to supply a toner to an electrostatic latent image formed on a photosensitive body and to develop the electrostatic latent image;

a first toner containing unit that contains a toner to be supplied to the developing unit;

a second toner containing unit that contains a toner and is connected to the first toner containing unit such that an optical path of light that is irradiated to the photosensitive body is disposed between the first and second toner containing units; and connecting units disposes in two regions outside an effective width of the optical path to connect the first and second toner containing units such that the toner is transferred from the second toner container unit to the first toner containing unit, wherein a bottom portion of the second toner containing unit is inclined downwardly in the width direction toward the connecting units.

22. The developing device of claim 21, wherein the developing unit is disposed on a downstream region from the first toner containing unit with respect to a proceeding direction of the light.

23. The developing device of claim 22, wherein a waste toner containing unit to contain waste toner removed from the photosensitive body is disposed in a side opposite to the developing unit with respect to the optical path of light, and wherein the waste toner containing unit is disposed on a downstream region from the second toner containing unit with respect to the proceeding direction of the light.

24. The developing device of claim 21, wherein the second toner containing unit comprises an agitating member to supply a toner toward the connecting units.

25. The developing device of claim 24, wherein the agitating member comprises a rotation axis that extends in a width direction of the second toner containing unit and an agitating wing disposed on the rotation axis, wherein the agitating wing comprises a first wing portion and a second wing portion adjacent to the connecting units, and wherein a length of the second wing portion in a radial direction is greater than a length of the first wing portion in the radial direction.

* * * * *

UNITED STATES PATENT AND TRADEMARK OFFICE

CERTIFICATE OF CORRECTION

PATENT NO. : 8,983,341 B2
APPLICATION NO. : 13/562348
DATED : March 17, 2015
INVENTOR(S) : Ji-won Moon It is certified that error appears in the above-identified patent and that said Letters Patent is hereby corrected as shown below:

Claims

Claim 1, Column 13, Line 34

Delete "unit in connected" and insert --unit connected--, therefor.

Claim 9, Column 14, Line 16

Delete "claim of" and insert --claim--, therefor.

Claim 10, Column 14, Line 20

Delete "claim of" and insert --claim--, therefor.

Claim 11, Column 14, Line 23

Delete "claim of" and insert --claim--, therefor.

Claim 11, Column 14, Line 24

Delete "unit is" and insert --units is--, therefor.

Signed and Sealed this
Twentieth Day of October, 2015

Michelle K. Lee

Michelle K. Lee
*Director of the United States Patent and Trademark Office*